United States Patent [19]

Cole

[11] 4,396,054

[45] Aug. 2, 1983

[54] METHOD FOR MAKING A DISTORTION-FREE MULTIPLE UNIT PROSTHESIS

[76] Inventor: Steve Cole, 2374 Sunset Point Rd., Clearwater, Fla. 33515

[21] Appl. No.: 230,340

[22] Filed: Feb. 2, 1981

[51] Int. Cl.[3] ..... B22C 7/02

[52] U.S. Cl. ..... 164/34; 164/35; 164/45; 164/249; 433/213

[58] Field of Search ..... 164/34–36, 164/45, 246, 249; 433/213

[56] References Cited

U.S. PATENT DOCUMENTS 3,695,333 10/1972 Costa et al. ..... 164/35

*Primary Examiner*—Gus T. Hampilos
*Assistant Examiner*—J. Reed Batten, Jr.
*Attorney, Agent, or Firm*—Ronald E. Smith

[57] ABSTRACT

Process for making a multiple unit fixed prosthesis. A conventionally prepared wax bridge is separated into a plurality of segments, a plurality of brace members are partially interconnected between the segments, and an anchoring member having the general configuration of the wax bridge is prepared for attachment to the segmented bridge by first securing a different support member to each pontic and coping of the bridge and by temporarily securing the anchoring member to a preselected one of the pontics or copings. All of the support members are then permanently secured to the anchoring member by an adhesive that does not introduce distortion into the bridge as it hardens. The segments of the bridge are then re-integrated, the brace members are completely connected to the integrally-formed bridge, and a stabilizer bar is employed to interconnect the bracing members and the anchoring member so that the integrity of the wax bridge configuration is maintained throughout the otherwise conventional casting procedure that produces the multiple unit fixed prosthesis.

1 Claim, 7 Drawing Figures

FIG. 6

METHOD FOR MAKING A DISTORTION-FREE MULTIPLE UNIT PROSTHESIS

BACKGROUND OF THE INVENTION

1. Field of the Invention

This invention relates generally to a process for making a multiple unit fixed bridge, and more specifically relates to such a process that is characterized by separation of the wax bridge into a plurality of independent segments, preparing the individual segments for re-integration by partially attaching a plurality of differing bracing means thereto, followed by completing the re-integration of the wax bridge and by final attachment of the bracing means thereto.

2. Description of the Prior Art

Techniques for making partial bridges that fit denture patients well are known, but techniques for making multiple unit fixed bridges that fit well other than as set forth hereafter, are unknown.

Partial bridges are essentially linear-in-configuration and, accordingly, the wax bridges from which they are made are relatively easy to manipulate without introducing distortion thereinto. Multiple unit fixed bridges, however, have the generally U-shaped configuration of the human mouth. The U-shaped wax bridges from which such bridges are made are therefore easily distorted during handling, with the result that dental patients often ar dissatisfied with their bridges. A need exists in the dental laboratory industry for a method of handling the U-shaped wax bridges that will eliminate or reduce to an irreducible minimum the introduction of distortion into the same so that a nearly perfect fit for the bridge can be attained, but such a method does not appear in the prior art.

SUMMARY OF THE INVENTION

The longstanding but heretofore unfulfilled need for such a method is now fulfilled by a process that contemplates the breaking down of the U-shaped wax bridge that is conventionally prepared into a plurality of essentially linear-in-configuration segments. Bracing members are at least partially attached at preselected locations on the now independently formed wax bridge and a U-shaped rigid anchoring means is first temporarily and then permanently secured to support members that are secured to different ones of the copings and pontics of the wax bridge. The unattached portions of the heretofore unattached bracing members are then fixedly secured to the wax bridge at preselected locations, and these bracing members are fixedly secured to the anchoring means by a rigid bar that maintains such bracing member and anchoring means in fixed spaced relation to one another. With the wax bridge so braced and anchored, conventional casting techniques are then employed to produce the final product which is a true, undistorted replica of the initial wax bridge.

It is therefore seen to be the primary object of this invention to provide a method for reinforcing a wax bridge so that it can be handled without thereby introducing distortions of its shape thereinto.

A closely related object is to provide such a method that does not require a higher level of skill in order to follow the novel steps of the method relative to the level of skill required in making multiple unit fixed prosthesis by earlier methods.

The invention accordingly comprises the features of construction, combination of elements, and arrangement of parts that will be exemplified in the construction hereinafter set forth, and the scope of the invention will be indicated in the claim.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF THE PREFERRED EMBODIMENT

Figure 1:
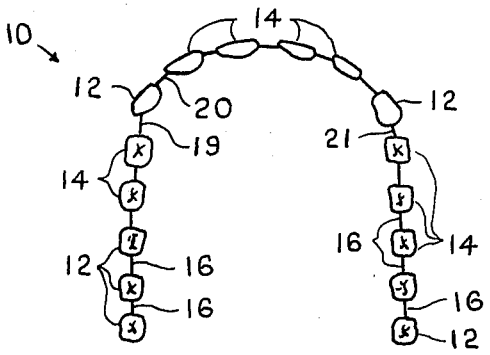
FIG. 1 is a schematic, plan view of a wax bridge made by conventional methods, showing the preselected locations at which such bridge is cut in accordance with the inventive method.

The inventive process will be exemplified in connection with the construction of a bridge for an entire upper or lower mouth, although the inventive process is applicable to partial bridges as well.

To prepare a patient for a bridge, the dentist extracts the teeth in need of extraction in accordance with medical principles, and employs a bur (a small rotary cutting tool with fluted edges disposed in a spiral configuration) to cut savable teeth down in size so that a crown may be made therefor as a part at the bridge. Healthy teeth are neither extracted nor cut down, of course, and serve as the support means at opposing ends of each bridge segment.

After the required extractions and cutting down procedures, the patient bites into a pliable material to make an impression of his or her teeth therein. A plurality of integrally-formed stone dies, each stone die representing a different tooth, is produced from the impression.

The stone dies are positioned on the flat surface of the base member, and saw cuts are made between contiguous ones of the stone dies to provide a plurality of individually formed dies. Each die is then mounted on an upstanding dowel pin individual thereto. Complementally formed, cooperatively positioned upstanding bores are formed in the base member to slidingly receive different ones of the dowel pins so that a replica of the teeth in the patient's mouth is provided when the dowel pins are slidingly received within their respective bores.

The stone dies are then lubricated with a tool known in the trade as a die spacer so that the wax to be applied to the stone dies to produce a wax bridge will not adhere to the stone dies.

Wax is applied to the stone dies representing cut down teeth to produce a coping. This application is made in a precise manner, so that the interproximal connections occur at the natural contact point, i.e., the sculptured wax teeth built up around stone dies representing cut down teeth are made to resemble natural teeth and accordingly are made to abut contiguous teeth in the natural manner.

The vacant spaces on the replica represent extracted teeth, of course. A wax pontic (a pontic is an artificial tooth on a dental bridge) is placed in each vacant area, which pontics are preselected to be miniatures or reduced dimension replicas of the final product desired.

The wax pontics, like the wax copings that are built up around the cut down (prepared) teeth, are also sculptered to have the contour of the final product desired. The copings and wax pontics are then interconnected in the conventional manner by connector means to provide an integrally-formed wax bridge that will ultimately provide a multiple unit fixed prosthesis (a unit being a tooth).

Such integrally-formed bridge is now separated from the stone dies. Any binding of the wax bridge is relieved so that the integrally-formed wax bridge is easily placed in at least partially capping relation to the complementally formed stone dies and easily separated therefrom.

The final preparatory step involves separating the wax bridge from the dies, removing the stone dies from the base, cleaning the dies and the base, and resinserting the dies onto the base (by inserting the dowel pin means into the respective pin receiving apertures formed in the base, as aforesaid), to properly seat the same thereon. With the cleaned and properly seated stone dies held firmly into position, the saw cuts in the base (made when the stone dies were separated, as aforesaid) are given an application of a wax known in the trade as sticky wax, and the integrally-formed wax bridge is replaced into overlying relation to the stone dies.

Conventional techniques for producing bridges next contemplate removing the wax bridge from the stone dies and manipulating the integrally-formed wax bridge to produce the final product. The U-shaped configuration of the wax bridge, however, is easily distorted, even when subjected to nominal amounts of externally imparted forces. The distortions introduced by manipulating the integrally-formed wax bridge produces a final product that causes discomfort to the patient. The conventional preparatory steps, described hereinabove, are believed to be sound, and are not the cause of poor-fitting bridges. It is the manipulation of the integrally-formed wax bridge after the preparatory steps have been completed, that is the source of patient dissatisfaction with his or her bridge.

The inventive process provides bridges that more precisely duplicate the replica of the patient's teeth, by substantially eliminating deformation of the wax bridge during the post-preparatory steps. This is accomplished, essentially, by separating preselected segments of the wax bridge so that deformation-inducing stress is not transmitted among the separated segments, by providing rigid bracing means to maintain the U-shaped configuration of the wax bridge during handling thereof, and by providing a generally U-shaped rigid anchoring means which anchors the individual pontics and copings of the wax bridge, and which is interconnected to the bracing means as well.

The specific procedures of the inventive process will now be described, and reference will be made to the accompanying drawings.

The integrally-formed wax bridge prepared by the above-described techniques is shown in FIG. 1 and is generally designated 10. Reference 12 represents stone dies which in turn represent healthy, unextracted teeth. The pontics or copings are indicated as 14, and the interproximal connections are designated 16. It will be noted that each group of copings or pontics 14 (hereinafter referred to as pontics) is flanked by stone dies 12. The pontics 14, together with the connectors 16 are thus seen to form bridges that are connected in support relation to and which interconnect adjacent, spaced apart stone dies 12. A stone die 12 contiguous to a pontic 14 is known as an abutment. To prevent the transmission of stress throughout the U-shaped wax bridge 10, the inventive method contemplates cutting preselected ones of the connectors 16 as at 19, 20, and 21, to separate the bridge into four individual segments, in this particular example.

Figure 2:
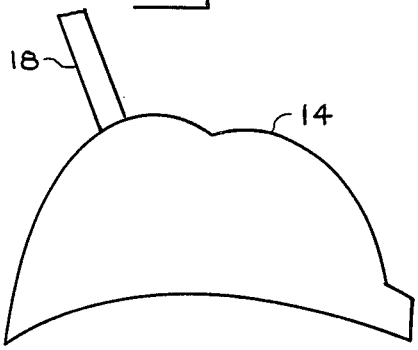
FIG. 2 is a schematic elevational view of a pontic or coping, showing a novel support means attached thereto in projecting relation therewith.

Referring now to FIG. 2, it will there be seen that a 4 mm in length, 12 gauge plastic sprue lead 18 is secured to each pontic 14 in the manner shown. The preferred adhesive for this purpose is sticky wax. In the claims appended hereto, sprue leads 18 are denoted as meltable support bar means. All references to plastic materials herein are thus understood to include any meltable or heat-labile material. Similarly, empirical studies may show that different gauges and different lengths of the various parts described herein may better perform the functions described herein, although the specific parameters as set forth herein are believed to be optimal.

Figure 3:
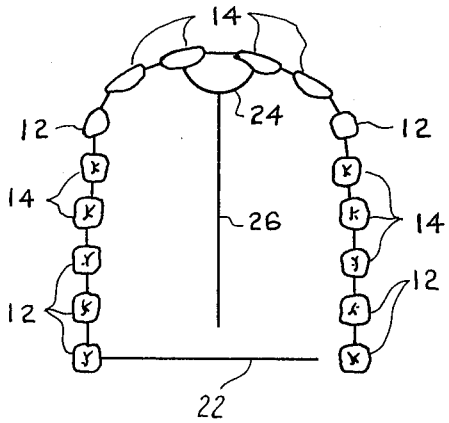
FIG. 3 is a schematic, plan view of the wax bridge of FIG. 1, showing the placement of the novel bracing means employed as a part of the inventive process.
Figure 7:
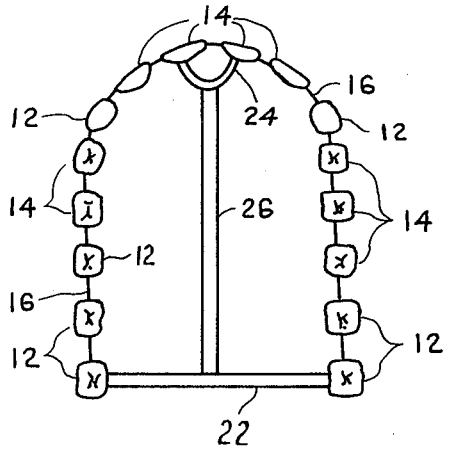
FIG. 7 is a schematic, plan view showing the bracing members of the invention and completely attached to the wax bridge, which view is to be compared with the view of FIG. 3 which shows the same bracing members in a partially attached, partially unattached configuration.

The independent wax bridge segments are then prepared for subsequent bracing by disposing a first meltable bracing bar means 22 (FIG. 3) intermediate of the opposed dies 12, 12 at the respective free ends of the wax bridge 10, and by securing one end of said first meltable bar means to a preselected die 12 as shown. A second and third meltable bracing bar means, indicated in FIG. 3 as elements 24 and 26, respectively, are then prepared for interconnection with the first meltable bracing bar means 22 by securing the opposed free ends of the second bar means 24 to adjacent anterior pontics, as shown in FIG. 3, by securing one end of the thid bar means 26 to the bight portion of the second bar means 24 as shown and by positioning the other end of the third bar means 26 in juxtaposition with the first bar means 22 as shown, leaving the same unconnected, as shown. In the preferred embodiment of the inventive process, the first bar means 22 is a 12 gauge plastic bar member, and the second and third bar means 24 and 26 are 13 gauge plastic bar members. Of course, the second and third bar members 24 and 26 are preferably integrally-formed one with the other, and are described as separate members only to facilitate the description. In the claim appended hereto, all references to second and third meltable bracing bar means are to be construed to include an integrally-formed meltable bracing bar means having a generally U-shaped portion for connecting to contiguous anterior pontics, and an elongate linear-in-configuration portion secured to the bight portion of said U-shaped portion and disposed to coincide with the axis of symmetry of the wax bridge, as shown in FIGS. 3 and 7, extending from said bight portion to the first bracing bar means 22, disposed orthogonally thereto, terminating in closely spaced relation to the medial portion of the first bracing bar means 22 to facilitate subsequent securement thereto.

Figure 4:
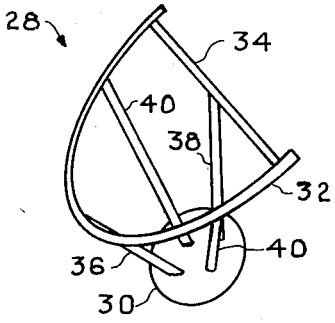
FIG. 4 is a perspective view of the anchoring means used in the inventive process.

The sprue leads 18, described above with reference to FIG. 2, are for supporting the inventive anchoring means, shown in perspective in FIG. 4 and generally designated 28. The anchoring means 28 comprises a base member 30, a U-shaped arch member 32, a transverse bar member 34 interconnecting the free ends of the arch member 32 and a plurality of legs interconnecting the base member 30 and the bight portion of the arch member 32, the base member 30 and the transverse bar member 34 substantially mid-length thereof, and the base member 30 and opposed parallel portions of the arch member 32, said legs designated as 36, 38, and 40, respectively. The legs 36, 38, and 40 clearly support the arch member 32 and transverse bar member 34 and maintain the same in functional spaced relation to the base 30, whereas transverse bar 34 clearly further maintains the rigid U-shape of the arch member 32. As will now be described, the arch portion 32 is rigidly connected to each pontic 14 of the wax bridge 10 at spaced intervals along the length thereof, in a highly critical manner, and the already described first, second and third bracing bar means, 22, 24, and 26, when ultimately secured to one another and to the stone dies, co-act with such arch member 32 and an additional stabilizer bar, hereinafter disclosed, to maintain the wax bridge 10 against deformation during the casting procedure which produces the final product.

Figure 5:
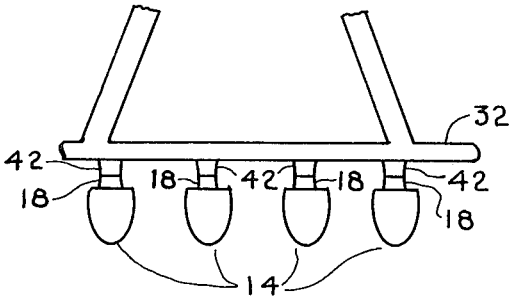
FIG. 5 is a schematic, end view showing how a segment of pontics is attached to the anchoring means of FIG. 4 through the use of the support means shown in FIG. 2 and through the use of an adhesive means.
Figure 6:
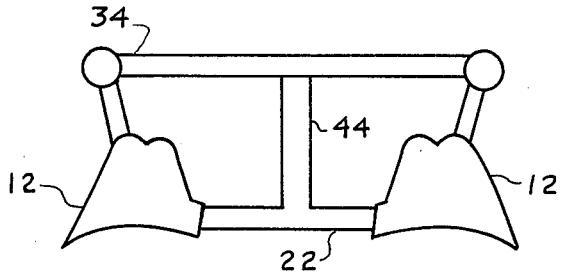
FIG. 6 is a schematic, end elevational view showing how the stabilizer bar means employed in the inventive process is employed to interconnect the anchoring means of FIG. 4 and a portion of the bracing means shown in FIG. 3.

More specifically, the anchoring member 28 is inverted relative to the position shown in FIG. 4, so that the base member 30 is disposed upwardly of the plane defined by the arch member 32, and the arch member 32 is gently allowed to abut the free ends of the 4 mm, 12 gauge sprue leads 18 (FIG. 2) at spaced intervals along the length of the arch member 32, as depicted in FIG. 5. Sticky wax is then employed to secure a single preselected sprue lead 18 to a portion of the arch member 32 in registration therewith, it being preferred to apply the sticky wax to the free end of the preselected sprue lead 18 prior to the placement of said arch member 32 thereagainst. An adhesive that neither expands nor contracts during its curing is then employed to fixedly secure each of the sprue leads 18 to the arch member 32. The preferred adhesive is DuraLay (tradmark) in that it has been found the DuraLey adhesive hardens without affecting the position of the pontics 14, the sprue leads 18, or the arch member 32. FIG. 5 depicts the bridge 10/anchoring member 28 assembly at this point. The DuraLay is designated as 42. After allowing the DuraLay 42 to harden (allow about 15 minutes), the wax bridge 10 is made integral again by re-connecting the abutments and pontics that were cut at preselected positions 19, 20, 21 as the initial post-preparatory steps of the inventive process, the free end of the first bracing bar member 22 is secured to the preselected stone die 12, and the free end of the third bracing bar member 26 is secured mid-length of the first bracing bar means 22, all as shown in FIGS. 6 and 7. A comparison of FIGS. 3 and 6 or 7 readily shows the described connections made at this point of the inventive process. Sticky wax is employed to make these connections.

The first bracing bar means 22 is then interconnected to the transverse bar 34 by an upstanding stabilizer bar means 44, as shown in FIG. 6. This unites the network of bracing bars 22, 24, 26 and the anchoring member 28. The stabilizer bar 44 also provides a passage, after it has melted during the conventional casting procedure, for the flow of molten metal to the posterior region of the wax bridge 10.

This essentially completes the inventive process, in that the remaining steps to produce the final bridge for the patient are conventional. An inlay investment is used for casting. After casting, the bridge is separated from the metallic bars which represent the sprue leads 18, but not from the metallic bars that represent the first, second and third bracing bars 22, 24 and 26. Conventional metal finishing, porcelain baking and glazing is performed with the metallic bracing bars representing bracing bars 22, 24 and 26 still connected to the bridge. They are finally removed to facilitate polishing of the final product.

It will thus be seen that the objects set forth above, and those made apparent by the preceding description, are efficiently attained, and since certain changes may be made in the above construction without departing from the scope of the invention, it is intended that all matters contained in the foregoing description or shown in the accompanying drawings shall be interpreted as illustrative and not in a limiting sense.

It is also to be understood that the following claim is intended to cover all of the generic and specific features of the invention herein described, and all statements of the scope of the invention which as a matter of language might be said to fall therebetween.

Now that the invention has been described,

That which is claimed is:

1. A method for making a dental bridge that fits the wearer thereof to an optimal degree, comprising the steps of preparing an integrally-formed wax bridge having a generally U-shaped configuration and connectors, separating the wax bridge into a plurality of integrally-formed bridge segments by cutting the connectors at preselected abutments, thereby eliminating the communication of distortion-creating stress among said segments, attaching a meltable support bar means to each pontic and coping of said wax bridge, preparing for the interconnection of preselected, opposed first and second posterior abutments disposed at the free ends of said U-shaped wax bridge by disposing a substantially rigid, first meltable bracing bar means intermediate of said opposed posterior abutments and connecting one end of said first meltable bar means to a first one of said abutments, interconnecting preselected, adjacent anterior abutments disposed at the bight portion of said U-shaped wax bridge by a substantially rigid, second meltable bracing bar means to hold said adjacent abutments in fixed space relation to one another, preparing to interconnect said first and second meltable bar means to one another by disposing a third meltable bracing bar means intermediate said first and second meltable bracing bar means along the axis of symmetry of said U-shaped wax bridge, and connecting said third meltable bar means to said second meltable bar means, fixedly securing each of said meltable support bar means at spaced intervals along the length of a meltable, integrally-formed, rigid anchoring member having a generally U-shaped configuration and having a linear-in-configuration transverse bar member that interconnects the opposed free ends of said U-shaped anchoring member such that said wax bridge and said anchoring member are disposed in spaced, parallel relation to one another, connecting said plurality of bridge segments to re-establish said integrally-formed wax bridge, connecting said opposed first and second posterior abutments by attaching said first meltable bar means to the second one of said abutments, to hold said opposed abutments in fixed, spaced relation to one another, connecting said third meltable bar means to said first meltable bar means, to establish a rigid frame formed by said first, second and third meltable bar means to hold the pontics and copings of said wax bridge in fixed, spaced relation to one another, disposing a stabilizer bar means in generally upstanding relation intermediate of said first meltable bar means and said anchoring member's transverse bar member and connecting opposed ends of said stabilizer bar means to the respective medial portions of said first meltable bar means and said transverse bar member to establish a rigid frame defined by said integrally-formed anchoring means and the wax bridge that is held substantially immobile by said first, second and third meltable bar means, producing a metallic casting including a metallic bridge and metallic members from the connected anchoring member and wax bridge, separting the metallic bridge formed from the metallic members representing the meltable support bar members, applying porcelain to said metallic bridge by a baking technique, and separating the metallic members representing said first, second and third meltable bar means from the porcelain covered metallic bridge.

* * * * *